US009389588B2

(12) United States Patent
Bas et al.

(10) Patent No.: US 9,389,588 B2
(45) Date of Patent: Jul. 12, 2016

(54) METHOD FOR ADJUSTING THE CHRONOMETRY OF A TIMEPIECE MOVEMENT INTENDED TO OPERATE IN A LOW-PRESSURE ATMOSPHERE

(71) Applicants: Kewin Bas, Geneva (CH); Cyrille Chatel, La Chenalotte (FR)

(72) Inventors: Kewin Bas, Geneva (CH); Cyrille Chatel, La Chenalotte (FR)

(73) Assignee: CARTIER INTERNATIONAL AG, Steinhausen (CH)

( * ) Notice: Subject to any disclaimer, the term of this patent is extended or adjusted under 35 U.S.C. 154(b) by 0 days.

(21) Appl. No.: 14/360,692

(22) PCT Filed: Nov. 30, 2012

(86) PCT No.: PCT/IB2012/002547
§ 371 (c)(1),
(2) Date: May 27, 2014

(87) PCT Pub. No.: WO2013/084040
PCT Pub. Date: Jun. 13, 2013

(65) Prior Publication Data

US 2015/0192900 A1 Jul. 9, 2015

(30) Foreign Application Priority Data

Dec. 9, 2011 (EP) ..... 11009676

(51) Int. Cl.
*G04B 17/24* (2006.01)
*G04B 37/02* (2006.01)
*G04B 17/06* (2006.01)

(52) U.S. Cl.
CPC ..... *G04B 17/24* (2013.01); *G04B 17/06* (2013.01); *G04B 37/02* (2013.01)

(58) Field of Classification Search
CPC ..... G04B 17/24; G04B 37/02; G04B 17/06; G04B 37/00
See application file for complete search history.

(56) References Cited

U.S. PATENT DOCUMENTS 3,630,014 A * 12/1971 Jeannet ..... G04B 17/00 310/36
8,147,127 B2 * 4/2012 Silva ..... G04B 17/06 368/144

(Continued)

FOREIGN PATENT DOCUMENTS

CH 15501 A 11/1897
CH 336765 A 4/1959

(Continued)

OTHER PUBLICATIONS

Translation—description—FR2054540—epo.org; Sep. 5, 2015.*

(Continued)

*Primary Examiner* — Sean Kayes
(74) *Attorney, Agent, or Firm* — Young & Thompson

(57) ABSTRACT

A method for regulating time-keeping of a mechanical timepiece movement intended to operate in a low-pressure atmosphere, includes the successive steps of: placing the movement in a low-pressure atmosphere pre-established for normal operation of the movement; measuring the gain or recoil (typically a gain +ΔP) of the time-keeping precision of the movement at this low pressure; returning the movement to ambient atmospheric pressure; at the ambient atmospheric pressure, regulating the movement to compensate for the previously measured gain or recoil; and returning the movement to the low-pressure atmosphere pre-established for normal operation of the movement.

12 Claims, 1 Drawing Sheet

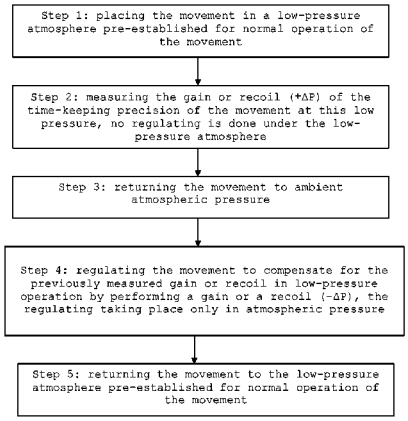

(56) References Cited

U.S. PATENT DOCUMENTS

| | | | | |
|---|---|---|---|---|
| 2002/0191493 | A1 | 12/2002 | Hara | |
| 2010/0034057 | A1 * | 2/2010 | Levingston ..... | G04B 17/227 368/175 |
| 2010/0157743 | A1 | 6/2010 | Silva | |

FOREIGN PATENT DOCUMENTS

| | | | |
|---|---|---|---|
| CH | 355742 | A | 8/1961 |
| CH | 463 402 | A | 6/1968 |
| CH | 556564 | A | 10/1974 |
| CN | 2249421 | | 3/1997 |
| CN | 1206861 | | 2/1999 |
| FR | 1 546 744 | A | 11/1968 |
| FR | 2 054 540 | A1 | 4/1971 |
| GB | 1272183 | A | 4/1972 |

OTHER PUBLICATIONS

International Search Report, dated Mar. 28, 2013, from corresponding PCT application.

Chinese Office Action dated Dec. 31, 2015; Application No. 201280060553.5.

Chinese Search Report dated Dec. 31, 2015, with partial English translation; Application No. 201280060553.5.

* cited by examiner

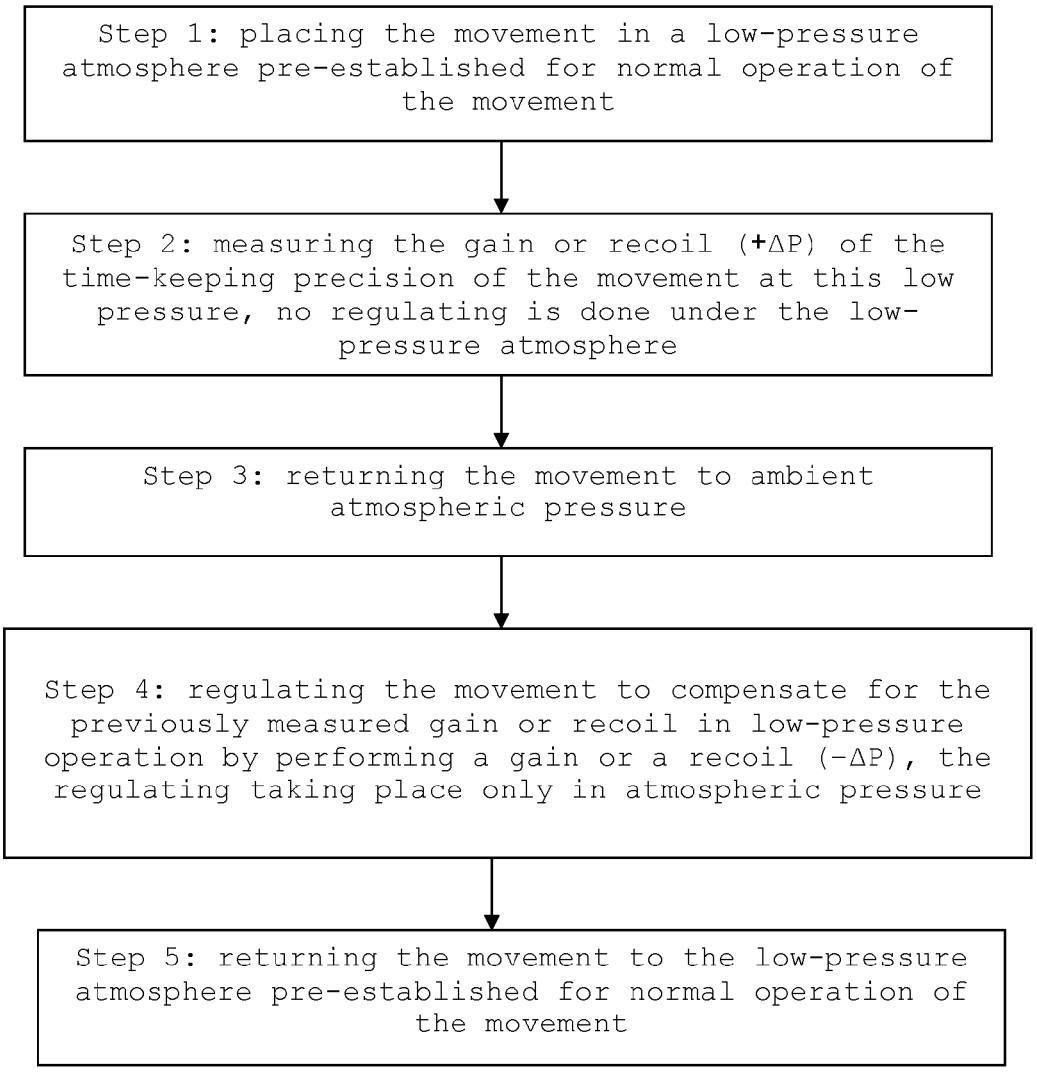
Step 1: placing the movement in a low-pressure atmosphere pre-established for normal operation of the movement
Step 2: measuring the gain or recoil (+ΔP) of the time-keeping precision of the movement at this low pressure, no regulating is done under the low-pressure atmosphere
Step 3: returning the movement to ambient atmospheric pressure
Step 4: regulating the movement to compensate for the previously measured gain or recoil in low-pressure operation by performing a gain or a recoil (-ΔP), the regulating taking place only in atmospheric pressure
Step 5: returning the movement to the low-pressure atmosphere pre-established for normal operation of the movement

METHOD FOR ADJUSTING THE CHRONOMETRY OF A TIMEPIECE MOVEMENT INTENDED TO OPERATE IN A LOW-PRESSURE ATMOSPHERE

The present invention relates to the regulating of the time-keeping of a mechanical timepiece movement intended to operate in a low-pressure atmosphere, i.e., cased-up in a sealed case in which the pressure is lowered to below atmospheric pressure and optionally the composition of the atmosphere is modified to limit oxidation, wear and aging of certain elements of the movement. Herein, "vacuum" or "protective atmosphere" or "low-pressure atmosphere" is understood to mean a pressure which is generally lower than atmospheric pressure, with or without an added gas, which is maintained within a case which has been optimised to preserve this low pressure.

DESCRIPTION OF THE RELATED ART

Documents such as CH 15501, CH 556564, CH 355742, CH 336765, CH 463402 or GB 1272183 are known and relate to watches intended to operate in a reduced-pressure atmosphere. These documents recommend the use of a reduced operating pressure to either reduce the oxidation of the metals and lubricants or to improve the sealing tightness of the watch case.

Moreover, as indicated in document FR2054540, by reducing the pressure prevailing within a watch case, the loss of energy owing to air friction tends towards zero and hence the quality factor of the oscillator of the timepiece movement increases considerably.

In order to improve the time-keeping qualities of a timepiece movement, document FR2054540 proposes three alternatives of a timepiece having an oscillator working in a casing in which a reduced pressure between $10^{-1}$-$10^{-5}$ mm Hg (0.13 mbar-1.3.$10^{-5}$ mbar) prevails. In accordance with the first and second alternatives, the low pressure prevails throughout the interior of the watch case and the oscillator comprises a balance spring, a regulator able to modify the frequency of the balance spring and two bimetallic blades. These blades are intended to act on the regulator and to increase or decrease the frequency of the oscillator when either one or the other of these bimetallic blades is heated by an electric wire controlled via the outside of the case. In accordance with the third alternative, the oscillator is a balance spring maintained electronically by coils co-operating with a magnetic field created by two magnets. In this third alternative, only the oscillator and its maintaining and regulating means are contained within a hermetically closed casing. As in the case of the other alternatives, bimetallic blades within the casing act on the regulator by a thermal effect controlled by means on the outside of the casing.

Although a movement in accordance with FR2054540 is designed based on the high vacuum in which its oscillator operates, this oscillator requires the presence and the operation of very complicated regulating means and an uncertain level of precision and reliability. The presence of the magnetic elements within a timepiece movement is also problematic because it can cause disruptive effects on the rate of the movement.

In a similar manner, document FR1546744 describes a precision timepiece in which a low-pressure atmosphere of a hundredth of a Torr (0.013 mbar) is generated within a support case. In accordance with one alternative, the case comprises a valve and the movement is provided with a regulator allowing regulating by electromagnetic influence through the case. In this instance, after casing-up the movement, the pressure within the case is reducing by means of the valve, and thereafter the oscillator is regulated by electromagnetic means. This alternative has the same disadvantages as a movement in accordance with FR2054540, described above. In accordance with a second alternative suggested in FR1546744, the case does not have a valve and once it is provided with its movement it is fed into a vacuum chamber where the movement is regulated under vacuum by chronocomparators by acting directly on the regulator as in the case of conventional regulating under atmosphere. After this regulating, and still under vacuum, the dome is screwed with a seal and the watch is removed from the vacuum chamber.

This alternative, which also corresponds to the usual methods for regulating a movement intended to operate in a reduced pressure atmosphere, does absolutely not take account of the major difficulties imposed by the need to directly actuate the regulator when the watch is within a vacuum chamber, and document FR1546744 provides no solution for this major problem. In fact, the watch must be open in the vacuum chamber to allow the regulating of the regulator using complicated means allowing work to take place in the vacuum chamber, then the watch must be sealingly closed before being removed from the vacuum chamber.

These documents in the prior art clearly show that it is necessary, for a watch operating in a reduced pressure atmosphere, to effect the regulating of the frequency of its oscillator whilst the watch or a part at least of its movement is held in a low-pressure casing, which involves complex regulating means, either the opening and closing of the watch case in a vacuum casing equipped with means allowing the regulating of the oscillator by tools located in the vacuum chamber, or to provide means able to regulate the oscillator from the outside of the case.

In fact, in the identified prior art, only documents FR 1546744 and FR 2054540 deal with the regulating of the oscillator operating at low pressure and these documents involve regulating of the regulating member when the movement is subject to the intended low operating pressure, which constitutes a complicated task requiring special means for the regulating.

SUMMARY OF THE INVENTION

The aim of the present invention is to propose a method allowing the regulating of the time-keeping of the oscillator of a mechanical timepiece movement intended to operate in a low-pressure atmosphere when the movement is subjected to ambient atmospheric pressure.

This allows the disadvantages of the known devices to be overcome since it is no longer necessary to provide special means for the regulating of the time-keeping of the movement in a reduced pressure atmosphere, this regulating taking place only in atmospheric pressure.

BRIEF DESCRIPTION OF THE DRAWING

FIG. 1 shows the steps of the present invention.

DETAIL DESCRIPTION OF THE INVENTION

The invention relates mainly to a mechanical timepiece movement comprising at least one oscillator or regulating member in the form of a balance spring. This mechanical timepiece movement also generally comprises at least one barrel, an escapement maintaining the oscillations of the balance spring and a finishing going train transmitting the drive force from the barrel to the escapement. This method of regulating the time-keeping relates more particularly to a line or set of movements of the same calibre comprising equivalent or identical components.

Of course, the aim to be achieved is that the mechanical timepiece movement has, when it operates in the reduced pressure atmosphere at a pre-established value, preferably between 5 mbar and 0.1 mbar, a time-keeping precision of substantially zero seconds per day allowing for generally permitted standard variation tolerances.

With reference to FIG. 1, the method in accordance with the invention comprises the following steps:

1. placing the movement in a low-pressure atmosphere pre-established for normal operation of the movement,
2. measuring the gain or recoil (+ΔP) in the time-keeping precision of the movement at this low pressure,
3. returning the movement to ambient atmospheric pressure,
4. regulating the movement subjected to ambient atmospheric pressure to compensate for the previously measured gain or recoil (by −ΔP) in low-pressure operation,
5. returning the movement to atmosphere, at the low pressure pre-established for normal operation of the movement.

This last step 5 can be effected after having cased-up the movement or it can be effected before the movement is cased-up (as described in European patent application 11009678 by the applicant).

In accordance with one embodiment, prior to placing the movement in a low-pressure atmosphere in step 1, the method includes the step of verifying, and if necessary regulating, the movement at atmospheric pressure so that it has a time-keeping precision of substantially zero seconds per day.

The gain or recoil in step 2 is typically a gain, ΔP being positive, and the regulating in step 4 is typically accomplished by effecting a recoil, −ΔP being negative.

Since the measurement effected in step 2 of the method can be performed visually, for example through the wall of a transparent vacuum chamber, or acoustically, it is not necessary to work on the movement whilst it is under vacuum. There is therefore no need to provide complicated working means in the vacuum chamber as in the case of known devices where the regulating of the regulator occurs under vacuum.

When it is necessary to regulate a series of identical movements, a first movement of the series of movements can be subjected to the regulating method described above. Then, the time-keeping precision variation +ΔP between the atmospheric pressure rate and the rate in reduced pressure atmosphere can be considered as a standard reference correction to be applied to all the other movements of the series of identical movements. Thus, for the second and following movements of a series of identical movements, it is sufficient to regulate them at atmospheric pressure for a compensating time-keeping precision −ΔP and then place these movements under the pre-established reduced pressure atmosphere so that their time-keeping precision is substantially zero seconds per day.

Thus, when a series of identical movements is to be regulated, this method allows rapid and simple regulating of the time-keeping since it is sufficient to regulate each movement in atmospheric pressure at a standard value −ΔP and then to place each movement in its case in reduced pressure atmosphere for its normal operation.

In one example, practical tests performed on a series of identical movements show a gain range of the order of +12 s/day to +14 s/day between the rate at atmospheric pressure and the rate at the reduced pressure pre-established for the normal operation of the movements.

By way of example, it can be stated that in measurements carried out on certain movements of a series of traditional factory movements, the following results are obtained:

Movement 1 (not regulated):
Amplitude at atmospheric pressure: 220°
Amplitude at 1 mbar: 260°
Rate at atmospheric pressure: +11 s/day
Rate at 1 mbar: +24 s/day
Delta rate: +13 s/day
Movement 2 (not regulated):
Amplitude at atmospheric pressure: 220°
Amplitude at 1 mbar: 268°
Rate at atmospheric pressure: +3.4 s/day
Rate at 1 mbar: +17 s/day
Delta rate: +13.6 s/day
Movement 3 (not regulated):
Amplitude at atmospheric pressure: 210°
Amplitude at 1 mbar: 270°
Rate at atmospheric pressure: −27 s/day
Rate at 1 mbar: −14.2 s/day
Delta rate: +12.8 s/day
Movement 4 (regulated):
Amplitude at atmospheric pressure: 220°
Amplitude at 1 mbar: 262°
Rate at atmospheric pressure: 0 s/day
Rate at 1 mbar: +13.3 s/day
Delta rate: +13.3 s/day The delta values between the different measurements vary between +13.6 s/day and +12.8 s/day, i.e., a variation of less than 1 s/day. By taking Δ=−13.2 s/day as the regulating value for regulating, in ambient atmospheric pressure, all the movements of the series, time-keeping values in vacuum varying between −0.4 s/day and 0.4 s/day would be obtained, which represents an excellent initial regulating value for a mechanical movement.

Thus, once the measurements described above are performed for several samples of a given movement (for example between 1 to 5 movements) and this time-keeping precision deviation value ΔP is known for this movement, it can be used for regulating numerous identical movements, which greatly facilitates the regulating process and also greatly decreases the time necessary for this regulating.

To retain good time-keeping, it is necessary to effect the necessary offset before placement under vacuum which eliminates all the complications associated with regulating to be effected under vacuum.

Since the step of placing under vacuum or under pre-established reduced pressure atmosphere is quite rapid, the movement can be placed under vacuum, its time-keeping can be measured (+x s/day), the movement can be returned to atmospheric pressure and it can be regulated to −x s/day, in order to have a rate of zero s/day under vacuum. This vacuum or low pressure is preferably between 5 mbar and 0.1 mbar.

Since these steps are relatively rapid, if it is desired to achieve an extremely high time-keeping precision, steps 3, 4, 5 and 6 of the method can be repeated for regulating a single movement until a time-keeping precision in operation in a reduced pressure atmosphere practically equal to zero s/day is achieved. In so doing, the advantage is always maintained that the step of regulating the time-keeping of the movement is always effected when the movement is in atmospheric pressure which prevents the need for any complex tools.

The invention claimed is:

1. A method for regulating time-keeping of a mechanical timepiece movement intended to operate in a low-pressure atmosphere, comprising the successive steps of:

1. placing the movement in the low-pressure atmosphere pre-established for normal operation of the movement,
2. measuring a gain or recoil (ΔP) of time-keeping precision of the movement during low-pressure operation in the low-pressure atmosphere,
3. returning the movement to ambient atmospheric pressure,
4. with the movement at the ambient atmospheric pressure, regulating the movement to compensate for the previously measured gain or recoil in during the low-pressure operation by performing a gain or a recoil (−ΔP), and
5. returning the movement to low-pressure atmosphere pre-established for normal operation of the movement, wherein the regulating of the movement takes place only in the ambient atmospheric pressure, and no regulating of the movement takes place during the low-pressure operation in the low-pressure atmosphere.

2. The method as claimed in claim 1, wherein steps 3, 4, 5 and 6 are repeated once or a number of successive times so as to refine the regulating of the time-keeping in operation in reduced pressure.

3. The method as claimed in claim 1, wherein in order to regulate a series of identical movements, steps 1 to 5 are performed on at least one sample of said series of movements and then, for the following movements of the series of movements, only steps 4 and 5 are performed, the measurement obtained in step 2 being considered as a standard value applied to all the movements of a series of identical movements.

4. The method as claimed in claim 3, wherein the sample(s) comprise at most 5 movements.

5. The method as claimed in claim 1, wherein step 5 is performed once the movement has been cased-up.

6. The method as claimed in claim 1, wherein step 5 is performed before the movement has been cased-up.

7. The method as claimed in claim 1, wherein the low-pressure atmosphere is between 5 mbar and 0.1 mbar.

8. The method as claimed in claim 1, wherein the gain or recoil in step 2 is a gain, ΔP being positive, and the regulating in step 4 is accomplished by performing a recoil, −ΔP being negative.

9. The method as claimed in claim 1, wherein steps 1 through 4 are performed before the movement has been cased-up.

10. The method as claimed in claim 1, wherein steps 1 through 2 are performed before the movement has been cased-up.

11. The method as claimed in claim 9, wherein the low-pressure atmosphere is between 5 mbar and 0.1 mbar.

12. The method as claimed in claim 10, wherein the low-pressure atmosphere is between 5 mbar and 0.1 mbar.

* * * * *